US005976009A

United States Patent [19]

Achen

[11] Patent Number: 5,976,009

[45] **Date of Patent: *Nov. 2, 1999**

[54] VENT WITH MULTI-APERTURED SECURITY GRATE

[76] Inventor: John J. Achen, 12432 Del Rico, Yuma, Ariz. 85367

[ * ] Notice: This patent is subject to a terminal disclaimer.

[21] Appl. No.: 09/088,607

[22] Filed: Jun. 1, 1998

Related U.S. Application Data

[63] Continuation-in-part of application No. 08/616,263, Mar. 15, 1996, Pat. No. 5,758,457.

[51] Int. Cl.[6] ..... E06B 7/02

[52] U.S. Cl. ..... 454/195; 52/198; 454/277

[58] Field of Search ..... 454/195, 271, 454/274, 277, 288; 52/101, 106, 198, 199

[56] References Cited

U.S. PATENT DOCUMENTS

| | | | |
|---|---|---|---|
| 2,930,309 | 3/1960 | Prager | 98/118 |
| 4,592,271 | 6/1986 | Young | 98/114 |
| 4,676,145 | 6/1987 | Allred | 98/29 |
| 4,754,696 | 7/1988 | Sarazen et al. | 98/29 |
| 4,770,087 | 9/1988 | Danley et al. | 98/87 |
| 5,120,273 | 6/1992 | Lin | 454/195 |
| 5,349,799 | 9/1994 | Schiedegger et al. | 52/473 |
| 5,487,701 | 1/1996 | Schedegger et al. | 454/271 |

*Primary Examiner*—Harold Joyce
*Assistant Examiner*—Derek S. Boles
*Attorney, Agent, or Firm*—Cahill, Sutton & Thomas, P.L.C.

[57] ABSTRACT

A security grate is disposed intermediate a conventional multi-apertured vent on the front of a garage door panel to prevent intrusion through the juxtaposed aperture in the panel. Straps or washers serving as a backing plate may be located on the interior of the panel to further hinder unwanted removal of the vent and the security grate from the panel to obtain access to the aperture in the panel. Alternatively, the security grate may be disposed adjacent the interior of the panel and then any backing plate variants may be omitted. A cover of insulating material is attachable adjacent the rear of the panel to prevent airflow through the panel aperture and to provide insulation. A transparent or translucent cover may be substituted for the insulating cover to provide illumination when the garage door is closed. A closeable opening may be provided in the cover to permit airflow therethrough on a selected basis. The openings in the security grate may be multi-apertured and rectangular, circular, or other configuration as a function of manufacturing criteria and airflow considerations.

18 Claims, 7 Drawing Sheets

VENT WITH MULTI-APERTURED SECURITY GRATE

CROSS-REFERENCE TO RELATED APPLICATION

The present application is a continuation-in-part application of an application entitled "VENT WITH SECURITY GRATE", filed Mar. 15, 1996, assigned Ser. No. 08/616,263, now U.S. Pat. No. 5,758,457, to be issued on Jun. 2, 1998, and describing an invention by the present inventor.

BACKGROUND OF THE INVENTION

1. Field of the Invention

The present invention relates to vent assemblies and, more particularly, to a vent assembly having a security grate for preventing access through a juxtaposed aperture.

2. Description of Related Art

During the summer time in the southwest, the temperature in an unvented enclosed garage increases to well over 100 degrees. Such a high temperature may cause damage or deterioration to temperature sensitive items stored or otherwise disposed within such garage. Moreover, the high temperature renders it very uncomfortable for persons working within the garage. To alleviate this problem, it is common to cut one or more apertures in a garage door and cover such aperture with a multi-louvered screened vent readily available in hardware stores. Such vents permit convective airflow through the garage door and generally restrains intrusion of larger sized insects. Because the commercially available vents are usually of aluminum or light sheet metal, they are easily destroyed to permit access to the juxtaposed aperture. The now accessible aperture permits a child or small adult to pass therethrough and permits use of extended tools and the like to unlock and open the garage door. The resulting accessibility to the garage and its contents is an invasion of privacy and promotes burglary. The garage owner, and particularly a homeowner having such a vented garage door, is therefore faced with the quandary of either accepting an unreasonably hot garage or risk intrusion.

To encourage airflow into and out of a garage through a closed garage door, one or more of the conventional types of vents are often located close to the bottom and to the top of the garage door. Such positioning permits escape of hot air through the upper vents due to convection and a compensatory inflow of cooler air through the bottom vents. Such plurality of apertures promotes air circulation with attendant cooling benefits but also provides a plurality of locations for intrusion into the confines of the garage.

SUMMARY OF THE INVENTION

To prevent physical intrusion of a human body through a venting aperture in a garage door, a security grate is positioned adjacent the aperture and inwardly of a conventional louvered vent. Fastening means, such as bolts having double lock nuts on the inside of the garage door, secure the vent and security grate in place while preventing unthreading of the bolts from the nuts. Preferably, the security grate is a sheet of iron or steel of sufficient thickness to prevent destruction by conventional tools. The apertures in the security grate are limited in size to preclude passthrough of a human body. The apertures may be further reduced to minimize the likelihood of intrusion of a tool to unlock the garage door by manipulation of the tool through the security grate. To more securely attach the vent and security grate, a backing plate may be lodged adjacent the interior surface of the garage door to receive and retain the fastening means extending therethrough from the vent. The venting apertures in the backing plate may be commensurate with the apertures in the security grate or of greater size since the purpose of the backing grate is not to prevent intrusion but to prevent removal of the security grate. During periods of cold weather, a sheet of insulating material may be located adjacent the rear of the garage door juxtaposed with the aperture to prevent airflow through the aperture and to provide an insulating medium. To help naturally illuminate the garage, the insulating sheet may be replaced with a transparent or translucent sheet that may or may not have insulating properties. To accommodate venting, the insulating medium and/or the transparent/translucent sheet may be slidably or hingedly retained to permit easy opening and closing of the adjacent aperture(s).

It is therefore a primary object of the present invention to provide a vent assembly for preventing intrusion through an apertured panel.

Another object of the present invention is to provide a vent assembly for preventing intrusion through a venting aperture of a garage door.

still another object of the present invention is to provide a security grate attendant an aperture in a garage door to accommodate venting of the garage while preventing intrusion into the garage.

Still another object of the present invention is to provide a vent assembly for discouraging intrusion into a garage which vent assembly may be closed with sheet material during periods of inclement weather.

A further object of the present invention is to provide a vent assembly for a garage door to prevent intrusion and which vent assembly is not dismantleable from outside of the garage.

A yet further object of the present invention is to provide a vent assembly having a security grate for a garage door and which vent assembly is closeable with translucent or transparent panels to permit light transmission through the garage door while preventing inflow of cold air.

A still further object of the present invention is to provide a method for preventing intrusion through a panel of a garage door while accommodating selective venting of the garage while retaining light transmission through the venting aperture.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 18 illustrates a variant of the mounting for the slidable doors and useable in conjunction with any of the vent assemblies;

FIG. 19 is a cross-sectional view illustrating the security grate on the inside surface of the garage door panel and including a slidably openable insulating/translucent/transparent cover, such as the type shown in FIG. 18;

FIG. 20 illustrates the fully open slidable cover portion shown in FIGS. 18 and 19;

FIG. 21 illustrates a partial view of a structure for positioning a C-channel to support sliding doors and the like;

DETAILED DESCRIPTION OF THE PREFERRED EMBODIMENT

Figure 1:
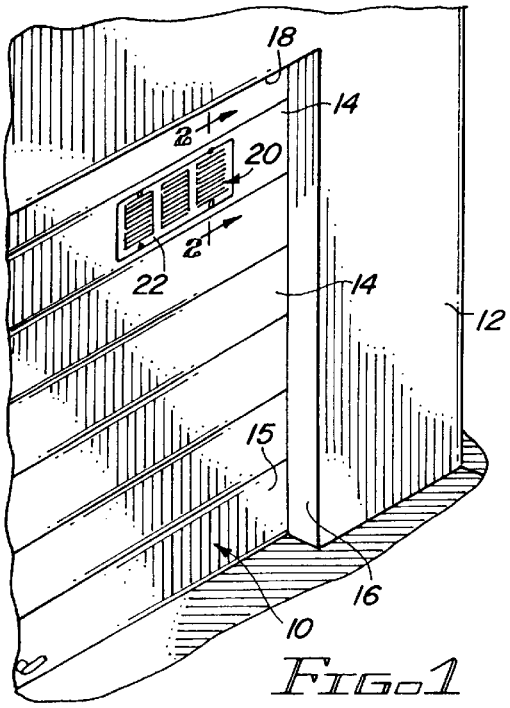
FIG. 1 illustrates a vent assembly mounted in a closed multi-paneled garage door.

Referring to FIG. 1, there is illustrated a closed garage door 10 located as part of a wall 12 of a garage, which garage may be of the type forming a part of a residence. The garage door depicted includes a plurality of horizontal panels 14 hingedly attached to one another and mounted within runners to permit upward and downward movement to open and close the garage door opening defined in part by post 16 and lintel 18. A vent assembly 20 is mounted in one of upper panels 14 to permit outflow of heated air from within the garage. Additional vent assemblies may be mounted within upper panel 14 to increase the rate of outflow. Furthermore, one or more vent assemblies 20 may be located in a lower panel 15 to accommodate inflow of cooler air and thereby encourage convective air circulation through the garage.

Vent 22 of vent assembly 20 may be of the conventional type available from most hardware stores or builder supply houses. As particularly depicted in FIG. 2, vent 22 includes three sets of louvers 24 to permit airflow therethrough but to discourage intrusion of rain droplets. Furthermore, these louvers preclude sunlight from penetrating the underlying aperture while accommodating light transmission therethrough. As is conventional, a screen (not shown) may be disposed adjacent the interior of louvers 24 to discourage passage of insects and debris through the vent. Generally, vent 22 is formed of thin aluminum or other metallic sheet material. The vent may also be of plastic. Thus, these vents are of limited structural strength and are easily damaged, cut or otherwise mutilated through use of simple conventional handtools. A vent 22 is commercially available for use with apertures in a panel, such as panel 14, and of a size sufficient to let a small person or child pass therethrough. Furthermore, essentially each aperture to be covered by conventional vent 22 is of a size sufficient to permit insertion of a tool or other implement to permit manipulation of the locking devices attendant the garage door. Thus, it is possible to unlock and open the garage door by access through an aperture covered by a vent 22 after the vent has been sufficiently mutilated or destroyed to expose the aperture. Necessarily, vent 22 compromises the security of a garage door and the contents of the garage. Furthermore, should the garage provide access to the interior of an associated residence, the security of the residence itself may be compromised.

Figure 2:
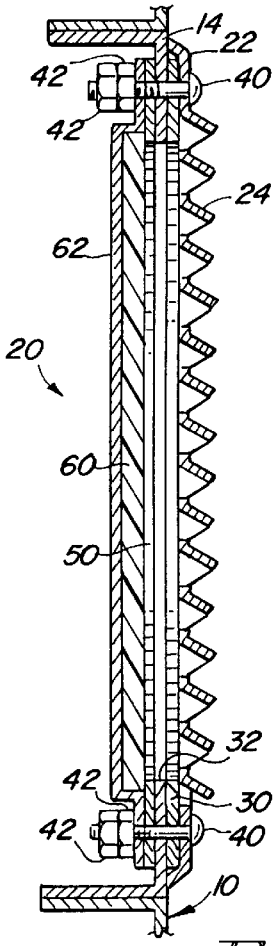
FIG. 2 is a cross-sectional view of the vent assembly taken along lines 2—2, as shown in FIG. 1.
Figure 3:
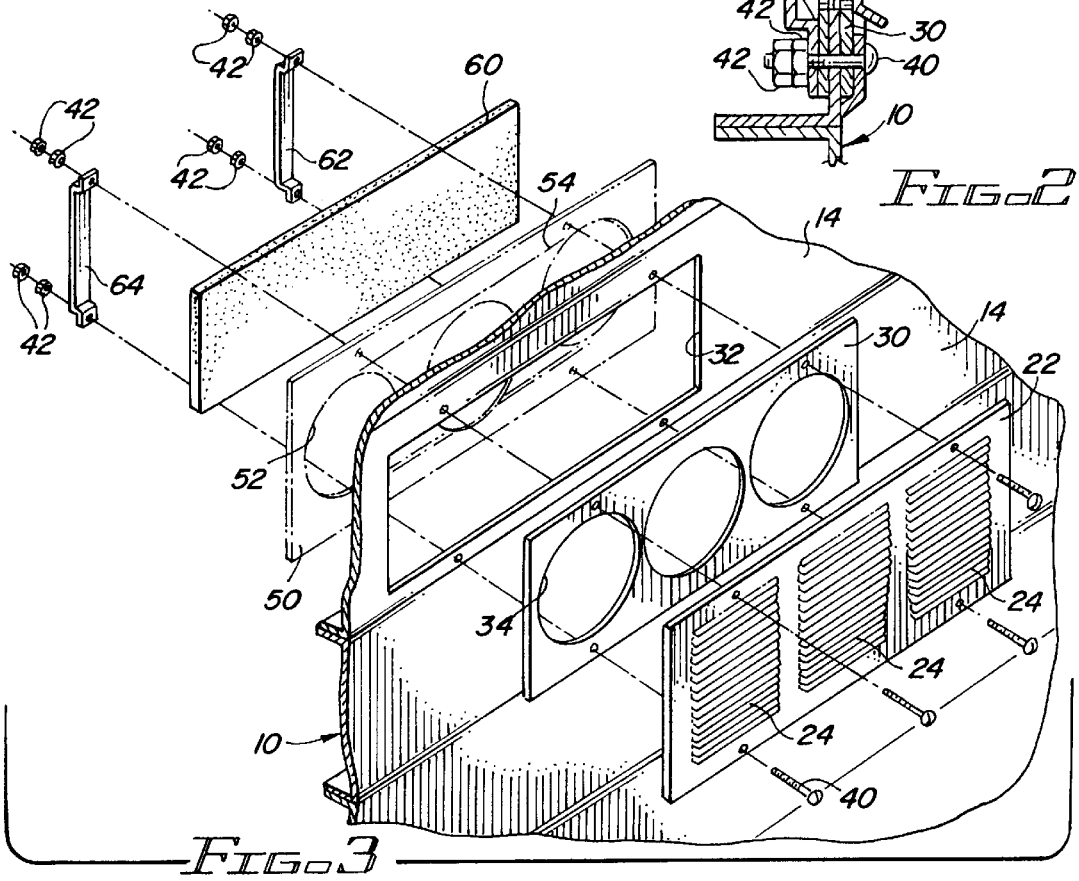
FIG. 3 is an isometric view of the embodiment of the vent assembly shown in FIG. 2.

As shown in FIGS. 2 and 3, a security grate 30 is disposed intermediate panel 14 and vent 22 to preclude intrusion through aperture 32 in panel 14. The security grate includes a plurality of apertures 34, such as the roundels depicted in FIGS. 3 and 4. These apertures are generally coincident with the depicted three sets of louvers 24 to accommodate airflow therethrough but the apertures are sized sufficiently small to prevent intrusion of a person therethrough. Furthermore, apertures 34 are sized sufficiently small to prevent or at least make very difficult insertion of a tool to bring about unlocking of the garage door. By forming security grate 30 of a sheet of steel or other difficult to mutilate material, mutilation or destruction of the security grate will be very difficult.

Fastening means, such as bolts 40 extend through holes located in vent 22, security grate 30 and panel 14 to retain these elements in juxtaposed relationship. By using double nuts 42, as depicted in FIGS. 2 and 3, turning of any of bolts 40 will not cause unthreading of the bolts from the nuts. Mechanisms other than double nuts may also be used if such mechanisms accomplish the dual purpose of retaining the vent, security grate and panel juxtaposed while precluding disengagement of the bolts. To prevent effective turning of bolts 40 after they have been tightened, one way slots may be employed in the bolt heads that permit a blade screwdriver to turn the bolt only in one direction.

Figure 5:
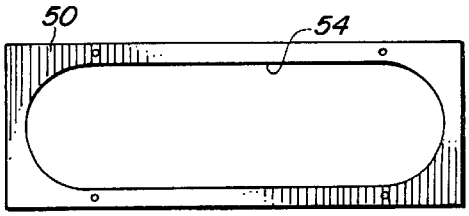
FIG. 5 is a view of a backing plate shown in FIG. 3.

Because the material of panel 14 of the garage door may be relatively thin in low cost garage doors, it may be prudent to incorporate a backing plate 50, as depicted in FIGS. 2, 3, and 5. Such a plate would be located adjacent the rear face of panel 14 and include one or more of aperture(s) 52 to accommodate airflow therethrough. Preferably, aperture 52 extends across and circumscribes apertures 34 in security grate 30 to minimize airflow restriction therebetween but a plurality of apertures coincident with apertures 34, as depicted, may be used. By forming backing plate 50 of relatively high strength material, such as steel, the possibility of forcibly pulling out the bolts and attached nuts therethrough would be impossible. Thus, detachment or dismantling of vent assembly 20 is very difficult even if panel 14 of the garage door is of limited strength material. As depicted by dashed line 54 in FIG. 3, a single elongated aperture 52 may be formed in backing plate 50 that is at least coincident with and may be larger than the totality of area defined by apertures 34 in security grate 30 to completely avoid any airflow restriction. Such large aperture does not compromise the security functions of the backing plate since the is remaining frame defined by the backing plate is sufficient to prevent pullthrough of the fastening means, such as bolts 40 with their attached nuts 42.

Figure 6:
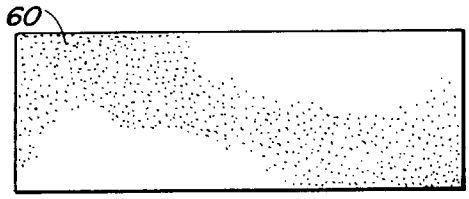
FIG. 6 is a view of an insulating/translucent/transparent cover shown in FIG. 3.

During winter or periods of inclement weather when airflow through vent assembly 20 is not desired, a cover 60 (see FIGS. 2, 3, and 6) may be located adjacent the rear face of backing plate 50, when used, to close the aperture in the backing plate. Necessarily, cover 60 has some temperature insulating capability, as shown in FIG. 3. Such insulating capability may be enhanced by making the cover of plastic foam or other material having a high temperature insulating factor. To prevent airflow through vent assembly 20 and yet permit transmission of light therethrough, cover 60 may be translucent or transparent. Cover 60 may be retained in place by a pair of straps 62,64 for securing the cover adjacent backing plate 50, as particularly illustrated in FIG. 2. These straps are penetrably engaged by bolts 40 and retained in place by pairs of nuts 42, as illustrated.

Figures 18, 19, 20, 21:
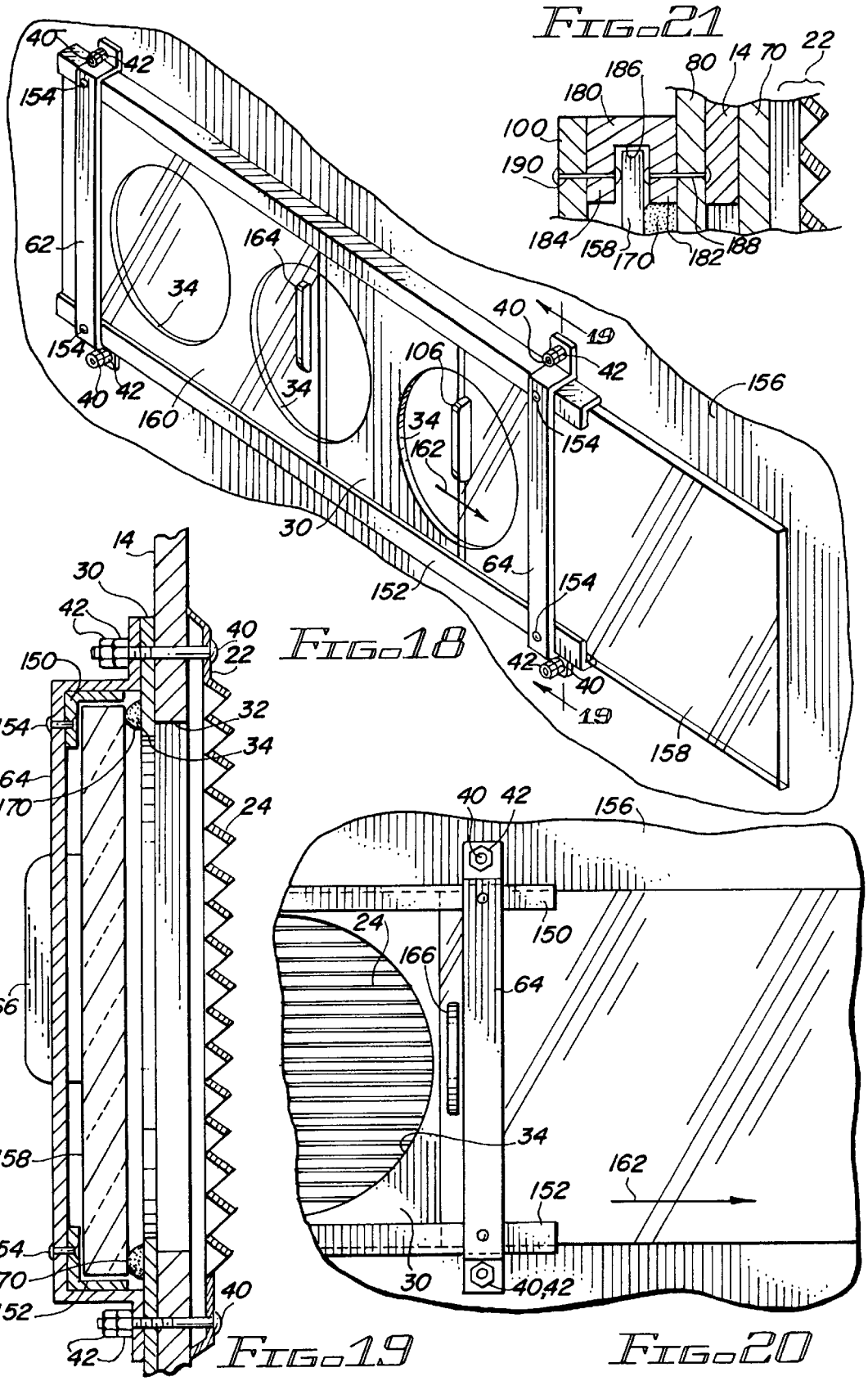

While the present preferred embodiment of the invention suggests positioning security grate 30 adjacent the outside surface of panel 14, such positioning is not mandatory. If the security grate is located adjacent the inside surface of panel 14 (as shown in FIG. 19), it accomplishes two functions. First, it provides the security function discussed above. Second, the robustness of the material of the security plate prevents pullthrough of pairs of nuts 42, as discussed above with respect to backing plate 50. Thus, the backing plate may be eliminated in this embodiment without compromising the security of the fastening means represented by bolts 40 and nuts 42.

Figure 4:
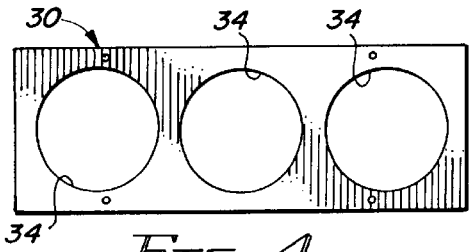
FIG. 4 is a view of a security grate shown in FIG. 3.
Figure 9:
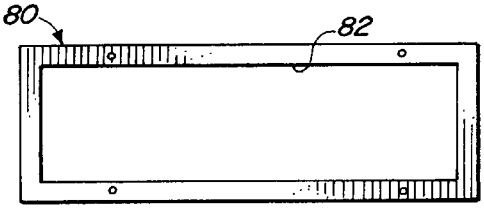
FIG. 9 is a view of a backing plate shown in FIG. 7.

Referring to FIG. 4, there is illustrated a variant of vent assembly 20 that may be less expensive to manufacture on a mass production basis than the vent assembly depicted in FIG. 3. Security grate 70 (see also FIG. 10) includes a plurality of rectangular apertures 72, which apertures may be essentially coincident with the respective openings of sets of louvers 24 to minimize airflow restriction and yet preclude intrusion of a tool or other implement for purposes of unlocking garage door 10. Such rectangular apertures may be less expensive than circles or roundels to manufacture by diecutting processes usually employed in sheet metal work. To provide the requisite resistance to mutilation or destruction, security grate 70 is preferably formed of a sheet of steel or of material having similar properties. Backing plate 80 (see also FIG. 9), if used, includes a single rectangular aperture 82 which is relatively easy and inexpensive to manufacture by conventional diecutting techniques. By embodying a single aperture, cost of fabrication of the backing plate is reduced and airflow therethrough is not impeded.

Figure 8:
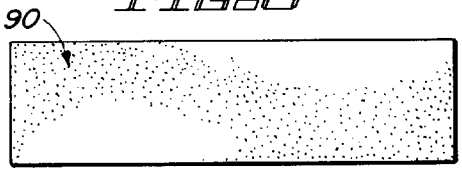
FIG. 8 is a view of an insulating/translucent/transparent cover shown in FIG. 7.

A cover 90 (see also FIG. 8) may be sized for insertion within aperture 82 and is preferably of a thickness commensurate with the thickness of backing plate 80. The lack of protrusion of cover 90 from the rear face of backing plate 80 permits flat straps 100,102 to be used. These straps extend across cover 90 and adjacent the frame of backing plate 80. Retention of the straps is established by penetrable engagement with corresponding bolts 40 and pairs of nuts 42 (as depicted in FIG. 2). By employing flat straps, the steps of bending of the straps, as depicted for straps 62,64 in FIGS. 2 and 3, can be eliminated. Furthermore, cover 90 may be of foam sheet material to preclude airflow through the backing plate and to provide a high degree of thermal insulation. Alternatively, cover 90 may be of translucent or transparent plastic material to permit illumination of the garage when garage door 10 is closed and also to provide a limited degree of thermal insulation. If backing plate 80 is not used, cover 90 may be attached directly to the rear surface of panel 14. If security grate 70 is attached to the rear and not the front surface of panel 14, as shown, cover 90, when used, can be attached directly to the security grate. Moreover, the cover can be formed as pieces nesting within apertures 72 or extending thereacross (as suggested from FIG. 2).

Figure 10:
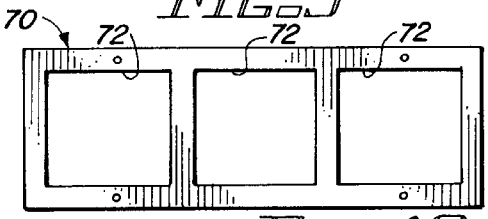
FIG. 10 is a view of a security grate shown in FIG. 7.
Figures 11, 12, 13, 14, 15, 16, 17:
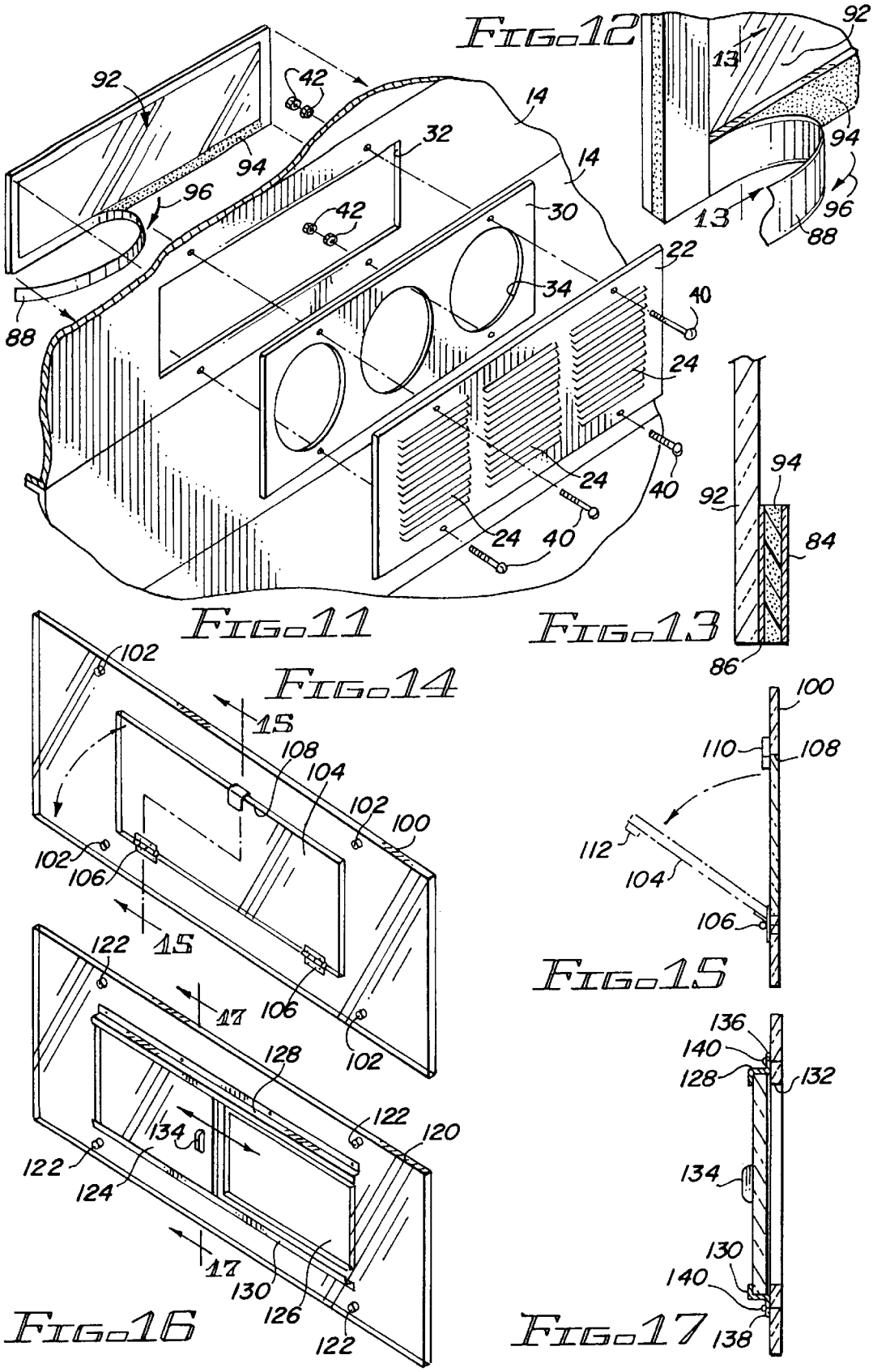
FIG. 11 is a view of a further variant of the vent assembly.
FIG. 12 is a detail view illustrating a mode of attachment for the insulating/translucent/transparent cover.
FIG. 13 is a cross-sectional view taken along lines 13—13, as shown in FIG. 12.
FIG. 14 is a rear view of an openable cover useable with any of the vent assemblies.
FIG. 15 is a view taken along lines 15—15, as shown in FIG. 14 and illustrating opening of the cover.
FIG. 16 is a rear view of a transparent/translucent cover having slidable doors for ventilation purposes and useable with any of the vent assemblies.
FIG. 17 is a cross-sectional view taken along lines 17—17, as shown in FIG. 16.

FIG. 11 illustrates a variant of vent assembly 20 secured to panel 14 adjacent aperture 32 of a garage door. A security grate 30, having apertures 34 generally coincident with each of sets of louvers 24 of vent 22 is placed adjacent panel 14 coincident with aperture 32. The vent, security grate, and panel 14 are secured to one another through a plurality of bolts 40 and lock nuts 42. While security grate 30 has been illustrated, it is to be understood that a security grate 70, as illustrated in FIG. 10, could be substituted. During periods of cold weather or at other times when aperture 32 is to be closed, a cover 92 may be attached to the inside surface of panel 14. Preferably, cover 92 is of translucent or transparent material to permit illumination of the interior of the garage. Alternatively, cover 92 may be of insulating material without any light transmissive qualities in the event the paramount concern is loss of heat through aperture 32.

As particularly illustrated in FIGS. 12 and 13, cover 92 may be attached to the rear face of panel 14 by use of a commercially available foam layer 94 having an adhesive layer 84,86, disposed on opposed sides. Foam layer 94 is secured about the perimeter of cover 92, as illustrated in FIG. 11, by adhesive layer 84 after a protective strip of tape (not shown) has been removed. The cover may be secured to the interior surface of panel 14 by removing a protective strip 88, as illustrated in FIGS. 11 and 12 and depicted by arrow 96. Upon exposure of foam layer 94, the cover is positioned adjacent panel 14 to become adhesively secured thereto. Thereby, cover 92 may be removed and installed at will as a function of the season or other considerations.

Referring jointly to FIGS. 14 and 15, there is shown an openable translucent or transparent cover 100 useable with one or another of the previously discussed vent assemblies. This cover may be adhesively attached, as illustrated in FIGS. 11, 12, and 13 or it may be attached by one or another set of straps 62,64 or 100,102. Alternatively, and as illustrated, cover 100 may include a plurality of apertures 102 located for penetrable engagement with respective ones of bolts 40. Thereby, cover 100 may be bolted to the remaining elements of the vent assembly being used. Cover 100 includes a door 104 pivotally secured to the cover by hinges 106 located along the bottom edge. Thereby, when the garage door is closed, the door will tend to remain in the open position in response to gravity. The opened door provides for ventilation through the vent assembly and the use of translucent or transparent material for the cover, framing the door, will contribute to transmission of light into the garage in addition to the light transmitted through opening 108 closeable by the door. When the door is closed, and if the door is of translucent/transparent material, cover 100 will transmit light into the garage. To secure the door in the closed position, sections 110,112 of hook and loop material, such as that sold under the trademark Velcro®, may be employed; alternatively, other retaining means could be incorporated.

Referring to FIGS. 16 and 17, there is shown another variant cover 120 useable in conjunction with any of the above-described vent assemblies. Preferably, the cover is of translucent/transparent material to permit transmission of light through the vent assembly into the garage. The cover may be secured by strips of adhesive, as illustrated in FIG. 13, by either of the types of straps illustrated in FIGS. 3 and 7. As shown, a plurality of apertures 122 may be formed in cover 120 for penetrable engagement with bolts 40 to secure the cover in place with lock nuts 42. A pair of sliding doors 124,126 are secured to cover 120 by guides 128,130. Thereby, sliding the doors apart from one another will expose aperture 132 in cover 120 and permit ventilation through the cover. If the sliding doors are of translucent or transparent material, as illustrated, the cover will be light transmissive whether the doors are open or closed. A knob 134 may be secured to either or both of the sliding doors to accommodate sliding manipulation of the doors. Guides 128,130 may be C-channels having one flange secured to cover 120 or S-shaped in cross-section, as illustrated, to permit attachment of each of flanges 136,138, respectively, to cover 120 by rivets, screws 140 (as illustrated), adhesive, etc.

FIG. 18 illustrates a variant of the sliding door assembly. A pair of opposed channels 150,152 are attached by rivets 154, or the like, to straps 62,64 (see FIG. 3). These channels may be C-channels in opposed facing relationship to is guide the doors therebetween or they may be right angled, as shown in FIG. 19. If right angled, the adjacent surface 156 serves in the manner of a positioning support for the doors. Doors 158,160 may be translucent or transparent to permit light transmission through apertures 34 of an adjacent security grate 30. Depending upon the material, the doors may also have a thermoinsulating effect. Sliding movement of the doors, as depicted by arrow 162, is augmented by knobs or handles 164 and 166. By inspection, it will be evident that the sum of the surface area of doors 158,160 may be more than equivalent to the open areas of security grates 30 or 70. Furthermore, security grate 30 illustrated in FIG. 18 may be replaced by security grate 70 shown in FIG. 10. As evident from FIG. 20, upon complete opening of the doors, as depicted with respect to door 158, the apertures in the security grate, such as apertures 34 in grate 30, are completely uncovered whereby the doors in the open position do not impede airflow through the security grate. By selective opening and closing of doors 158,160, the amount of ventilation through the vent assembly can be controlled. Because the doors may be of translucent or transparent material, closing of the doors does not significantly impede transmission of light through the vent assembly into the garage.

As particularly shown in FIG. 19, the security grate, whether security grate 30 or security grate 70, is located adjacent the interior surface of panel 14 of the garage door. Such location of the security grate eliminates the need for a backing plate to prevent forced withdrawal of bolts 40 and attached nuts 42 through panel 14. When doors 158,160 are closed to prevent inflow of cold air, air leakage around the doors may be prevented by use of a sealing material 170 disposed about the apertures in the security grate. Sealing material useful for this purpose include readily available strips of adhesive backed foam which compresses to some degree upon closure of the doors to form a seal therewith.

It is to be noted that differently configured door retaining channels may be employed to accommodate sliding movement of the doors and the mechanisms for attaching such channels to the adjacent supporting element may vary as well as the supporting element itself. For example, if the assembly supporting doors 158,160, were used in the configuration illustrated in FIG. 3, the adjacent surface may be either the backing plate, if used, or panel 14 of the garage door. A similar arrangement would exist with respect to the variants shown in FIGS. 7 and 14. For this reason, the nomenclature of supporting surface for element 156 is used instead of specifically identifying a particular element.

Referring to FIG. 21, there is illustrated a C-channel 180, such as one of the variants discussed above, for supporting sliding doors or the like. The C-channel includes a pair of side walls 182,184 defining a channel 186 for slidingly supporting one edge of door 158. It is to be understood that the opposite edge of the door may be supported by a corresponding C-channel. Side wall 182 may be riveted to backing plate 80 by rivet 188; other means, such as bolt and nut, selftapping screws, adhesives, etc. may be used to secure the C-channel. If necessary for purposes of structural rigidity, a strap, such as strap 100 illustrated in FIG. 7, may be attached to and extend between opposing C-channels 180. The strap may be attached to side wall 184 of the C-channel by a rivet 190; other attachment means, such as bolt and nut, selftapping screws, adhesives, etc. may also be used. In the event a backing plate 80 is not used in the vent assembly, the opposing C-channels may be attached directly to panel 14. If security plate 170 is adjacent the rear surface of panel 14, the opposing C-channels may be attached thereto in the manner shown and described above with respect to backing plate 80. Finally, the opposing C-channels may be attached to and secured in place by each of straps 62,64, as shown in FIGS. 18 and 19 with respect to channels 150,152.

Figure 22:
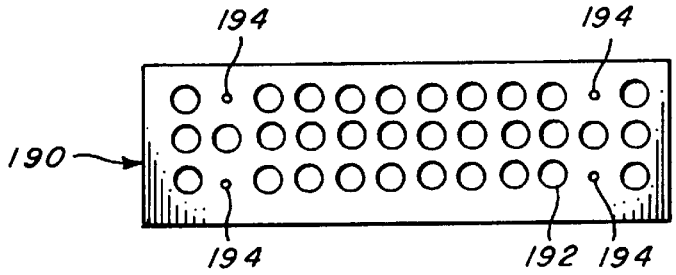
FIG. 22 illustrates a security grate having a plurality of apertures for ventilation purposes.

Referring to FIG. 22, there is illustrated an alternate construction of the security grate and identified by numeral 190. It includes a plurality of relatively small sized apertures 192 which may be in the range from about ½ inch to about 1-½ inches in diameter. It is intended that a sufficient number of these apertures be formed in the security grate to approximate the vent area represented by vent 22 and thereby not restrict, except to a minimal extent, airflow through the garage door panel. Moreover, a plurality of such smaller sized apertures provides the advantage of lower fabrication costs and serves as a significant impediment to intrusion of a tool or other device through the security grate for the purposes of rendering same ineffective or of opening the garage door. Security grate 190 may be substituted for any of the security grates previously discussed and as illustrated in FIGS. 4, 6, 9 and 10.

Figure 23:
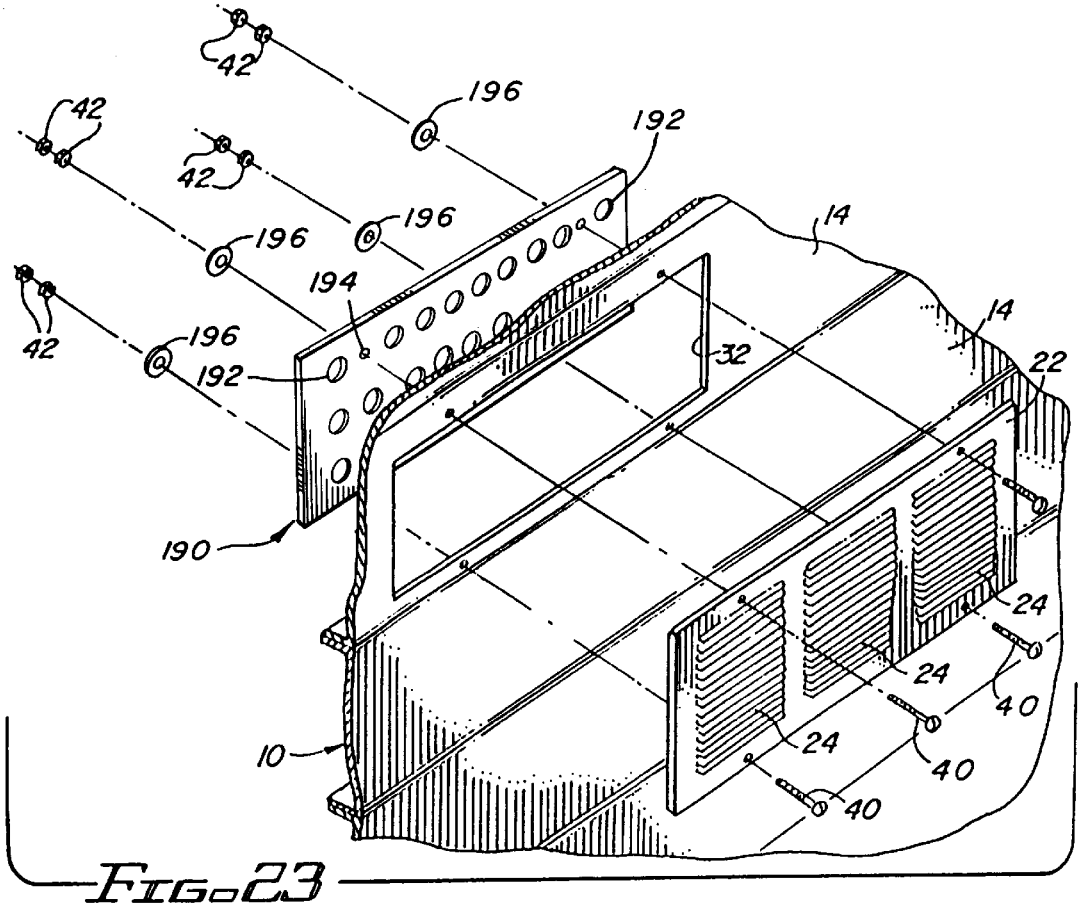
FIG. 23 illustrates placement of the security grate on the inside surface of the garage door panel and held in place by nuts engaging penetrating bolts.

Referring to FIG. 23, there is shown an assembly very similar to that depicted in FIG. 3. Elements common to both figures are identified with identical reference numerals. Security grate 30 depicted in FIG. 3 has been removed from the front of panel 14. Security panel 190 (depicted in FIG. 22) is placed adjacent the interior surface of panel 14 in juxtaposed relationship with aperture 32. Security grate 190 is retained in place by bolts 40 penetrably engaging corresponding apertures 194 in security grate 190. Straps 62,64 shown in FIG. 3 have been eliminated. In their place, washers 196 are mounted upon bolts 40 and retained in place by nuts 42 (or variants thereof as discussed previously).

Figure 7:
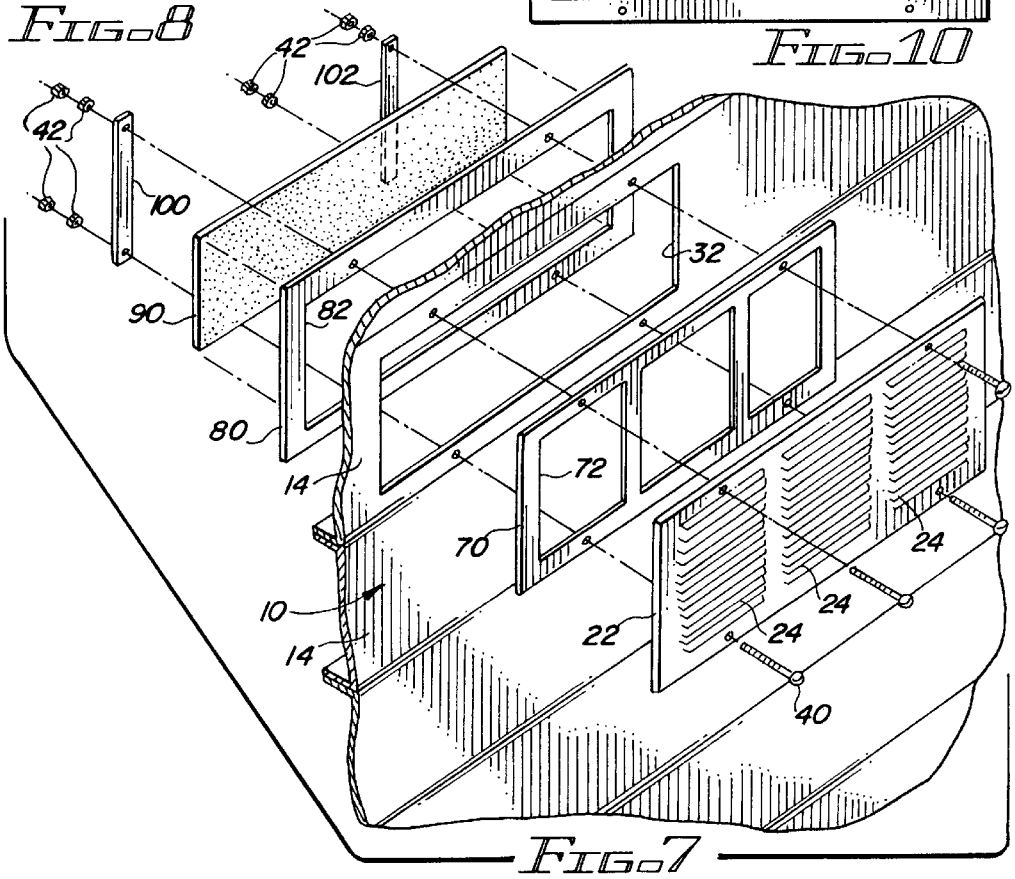
FIG. 7 is an isometric view of a variant of the vent assembly.
Figure 24:
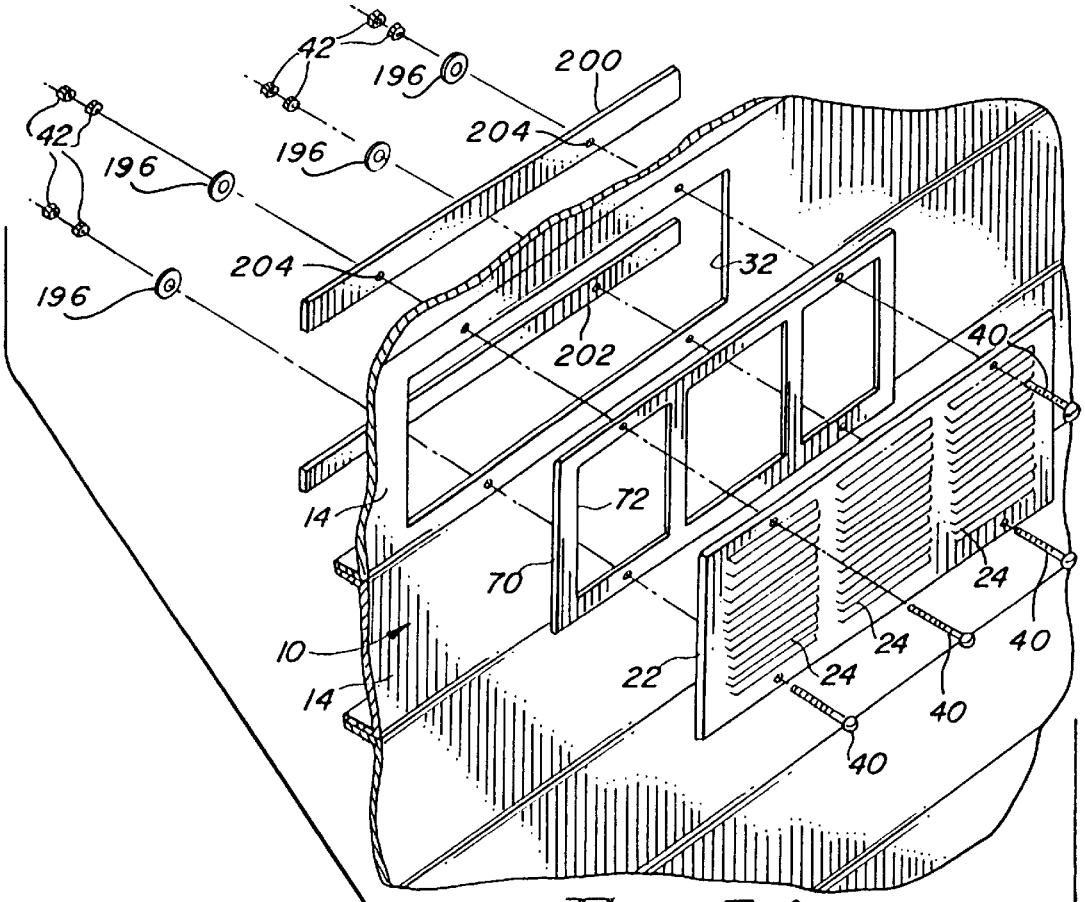
FIG. 24 illustrates the use of straps serving in the manner of a backing plate to retain the security grate in place.

As shown in FIG. 24, which figure is very similar to FIG. 7 and common reference numerals will be used for the same elements, backing plate 80 has been eliminated as well as optional cover 90. The function of a backing plate is performed by a pair of straps 200,202 located adjacent the rear surface of panel 14. These straps include apertures 204 for penetrable engagement by bolts 40. Optional washers 196 may be penetrably mounted upon bolts 40 intermediate the respective strap and nuts 42. If a cover 90 or the like is not to be used, straps 100,102 may be deleted. While security grate 70 is depicted, it is to be understood that multi-apertured security grate 190 may be substituted therefor.

Figure 25:
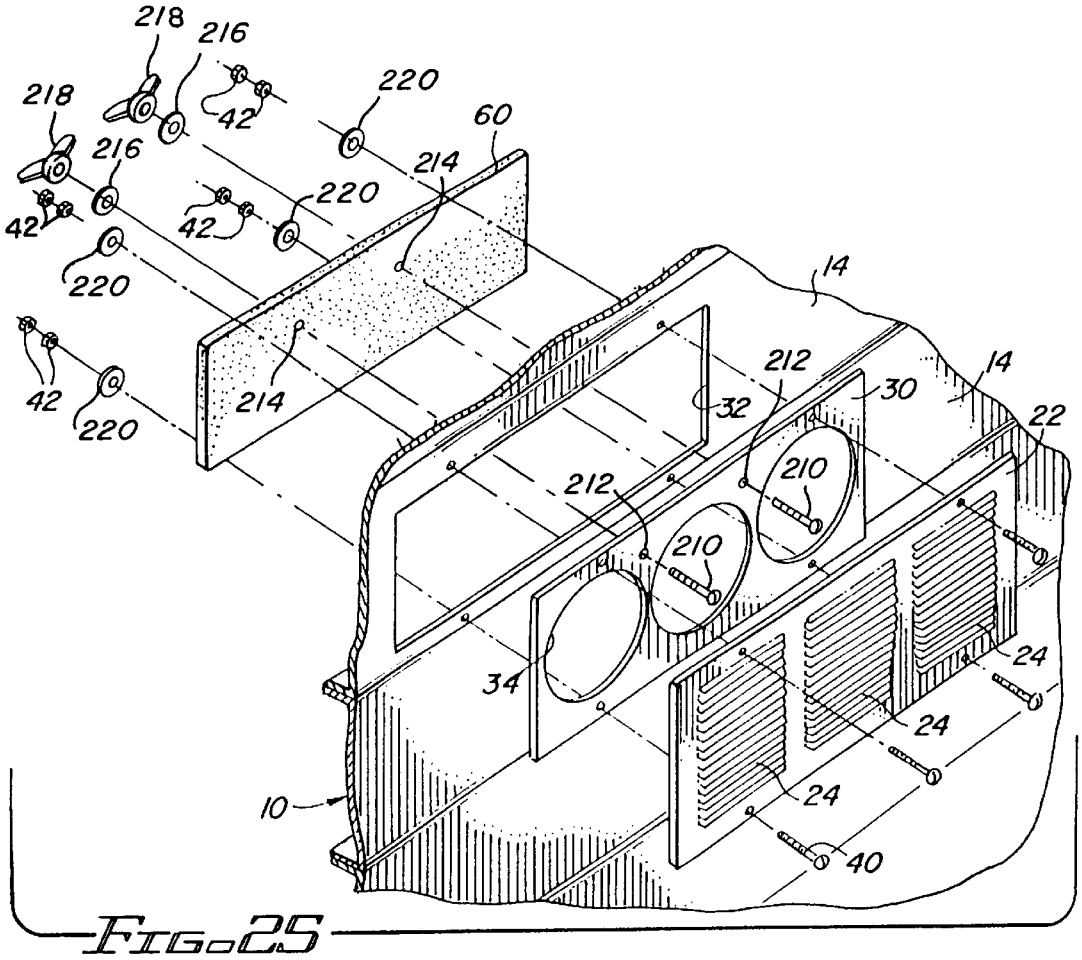
FIG. 25 illustrates the use of washers serving in the manner of a backing plate to retain the security grate in place and also illustrates an alternative use of bolts and wing nuts to retain a cover in place.

FIG. 25 is similar to FIG. 3 and common reference numerals will be used for the same elements. FIG. 25 primarily depicts a mechanism for easily attaching and detaching cover 60, whether opaque, temperature insulative, translucent or transparent. In particular, a pair of threaded bolts 210 penetrably engage security grate 30; to prevent rotation of these bolts, apertures 212 in the security grate may be threaded to threadedly engage and lockingly retain bolts 210 therein. Cover 60 includes a pair of apertures 214 correspondingly aligned with bolts 210 to permit mounting of cover 60 upon the ends of the bolts extending interiorly through panel 14. A pair of washers 216 penetrably engage bolts 210 and wing nuts 218 permit tightening of the washers against cover 60 to retain the cover adjacent panel 14 or the rear surface of security grate 30 in the event aperture 32 is of sufficient size to accommodate insertion of the cover. Through the use of wing nuts 218, cover 60, whether opaque, thermally insulative, translucent, or transparent, is readily mounted and dismounted to accommodate changes in climatological conditions or for other purposes.

To reduce the costs attendant use of a backing plate, such as backing plate 50 depicted in FIG. 3, relatively large sized washers 220 may be mounted upon bolts 40 and located adjacent the interior surface of panel 14. These washers are retained in place by nuts 42, as discussed above. Through the use of relatively large diameter washers, it will be very difficult, if not impossible, to attempt to forcibly withdraw bolts 40 (and vent 22 along with security grate 30) from panel 14 and thereby attempt to obtain access to the garage through aperture 32. While security grate 30 is depicted in FIG. 25, it is to be understood that security grate 190, depicted in FIG. 22, could be used in its place to obtain the benefit of its advantages.

The embodiments illustrated in any of FIGS. 22–25 may be substituted for the functionally equivalent structures depicted in the embodiments of the invention discussed previously. For example, security grate 190 could be substituted for any of the previously discussed security grates, whether mounted on the front or back surface of panel 14. Similarly, the backing plates previously discussed could be eliminated in favor of either straps 200,202 or washers 220. Furthermore, the various straps or other mechanisms for securing any of the covers, whether opaque, insulative, translucent, or transparent, could be secured by use of bolts 210 in combination with wing nuts 218.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A vent assembly for use with an aperture of a panel, said assembly comprising in combination:

(a) an apertured vent for permitting airflow therethrough;

(b) a security grate comprising a rigid apertured plate and adapted to extend across the aperture in the panel for preventing intrusion through the aperture, said vent and said security grate being adapted to be on one side of the panel;

(c) a pair of straps serving in the manner of a backing plate and adapted to be on the other side of the panel for retaining said security grate in place; and (d) attaching means adapted to secure at least said security grate and said pair of straps to one another in juxtaposed relationship with the aperture in the panel.

2. The vent assembly as set forth in claim 1 wherein said attaching means is adapted to interconnect said vent, said security grate, and said pair of straps to one another and with the panel.

3. The vent assembly as set forth in claim 1 including a cover adapted to extend across the aperture in the panel for preventing airflow through the aperture in the panel and retaining means adapted to secure said cover in juxtaposed relationship with the aperture in the panel.

4. The vent assembly as set forth in claim 3 wherein said retaining means comprises bolts extending from said security grate for penetrable engagement with said cover and wing nuts for retaining said cover on said bolts.

5. A vent assembly for use with an aperture of a panel, said assembly comprising in combination:

(a) an apertured vent for permitting airflow therethrough;

(b) a security grate comprising a rigid apertured plate and adapted to extend across the aperture in the panel for preventing intrusion through the aperture, said vent and said security grate being adapted to be on one side of the panel;

(c) at least one washer serving in the manner of a backing plate and adapted to be on the other side of the panel for retaining said security grate in place; and (d) attaching means adapted to secure at least said security grate and said at least one washer to one another in juxtaposed relationship with the aperture in the panel.

6. The vent assembly as set forth in claim 5 wherein said at least one washer comprises four washers.

7. The vent assembly as set forth in claim 5 wherein said attaching means is adapted to interconnect said vent, said security grate, and said at least one washer to one another and with the panel.

8. The vent assembly as set forth in claim 5 including a cover adapted to extend across the aperture in the panel for preventing airflow through the aperture in the panel and retaining means adapted to secure said cover in juxtaposed relationship with the aperture in the panel.

9. The vent assembly as set forth in claim 8 wherein said retaining means comprises bolts extending from said security grate for penetrable engagement with said cover and wing nuts for retaining said cover on said bolts.

10. A security assembly for use with an aperture in a garage door panel having one side and another side, said assembly comprising in combination:

(a) a louvered vent adapted to extend across the aperture in the panel on one side of the panel;

(b) a security grate comprising a rigid multi-apertured plate disposed in juxtaposed relationship with the aperture in the panel;

(c) at least one backing plate adapted to be located on the other side of the panel for retaining said security plate in place; and (d) attachment means adapted to retain said security grate and said at least one backing plate to one another and adjacent to the panel, said attachment means being adapted to be lockingly secured on the other side of the panel for preventing removal of said security grate from the one side of the panel.

11. The security assembly as set forth in claim 10 wherein said backing plate comprises at least one strap.

12. The security assembly as set forth in claim 10 wherein said backing plate comprises a pair of straps.

13. The security assembly as set forth in claim 10 wherein said backing plate comprises at least one washer.

14. The security assembly as set forth in claim 10 wherein said backing plate comprises more than one washer.

15. A method for preventing ingress through an aperture in a panel having one side and another side while accommodating airflow therethrough, said method comprising the steps of:

(a) locating a vent coincident with the aperture in the panel and adjacent one side of the panel;

(b) positioning a security grate having a plurality of apertures smaller than the aperture in the panel adjacent the one side of the panel in juxtaposed relationship with the aperture in the panel;

(c) retaining the security grate in place with a pair of straps located adjacent another side of the panel; and (d) fastening at least the security grate and at least the pair of straps with one another and to the panel with attachment means.

16. A method for preventing ingress through an aperture in a panel having one side and another side while accommodating airflow therethrough, said method comprising the steps of:

(a) locating a vent coincident with the aperture in the panel and adjacent one side of the panel;

(b) positioning a security grate having a plurality of apertures smaller than the aperture in the panel adjacent the one side of the panel in juxtaposed relationship with the aperture in the panel;

(c) retaining the security grate in place with washers located adjacent another side of the panel; and (d) fastening at least the security grate and at least the washers with one another and to the panel with attachment means.

17. A security assembly for use with an aperture in a garage door panel having one side and another side, said assembly comprising in combination:

(a) a louvered vent adapted to extend across the aperture in the panel on one side of the panel;

(b) a security grate comprising a rigid multi-apertured plate disposed in juxtaposed relationship with the aperture in the panel; and (c) attachment means adapted to retain said security grate and said vent to one another and adjacent to the panel, said attachment means being adapted to be lockingly secured on the other side of the panel for preventing removal of said security grate from the one side of the panel.

18. The security assembly as set forth in claim 17 wherein said security grate is adapted to be on the other side of the panel.

* * * * *